US005468957A

United States Patent [19]

Franzen

[11] Patent Number: 5,468,957

[45] Date of Patent: Nov. 21, 1995

[54] EJECTION OF IONS FROM ION TRAPS BY COMBINED ELECTRICAL DIPOLE AND QUADRUPOLE FIELDS

[75] Inventor: Jochen Franzen, Bremen, Germany

[73] Assignee: Bruker Franzen Analytik GmbH, Bremen, Germany

[21] Appl. No.: 245,967

[22] Filed: May 19, 1994

[30] Foreign Application Priority Data

May 19, 1993 [DE] Germany ..... 43 16 738.1

[51] Int. Cl.[6] ..... H01J 49/42

[52] U.S. Cl. ..... 250/282; 250/292

[58] Field of Search ..... 250/281, 282, 250/290, 291, 292

[56] References Cited

U.S. PATENT DOCUMENTS

| | | | |
|---|---|---|---|
| Re. 34,000 | 7/1992 | Syka et al. | 250/292 |
| 2,939,952 | 6/1960 | Wolfgang et al. . | |
| 4,818,864 | 4/1989 | Allemann | 250/290 |
| 4,818,869 | 4/1989 | Weber-Grabau . | |
| 4,975,577 | 12/1990 | Franzen et al. | 250/291 |
| 5,028,777 | 7/1991 | Franzen et al. | 250/291 |
| 5,206,509 | 4/1993 | McLuckey et al. | 250/292 |
| 5,291,017 | 3/1994 | Wang et al. | 250/282 |

FOREIGN PATENT DOCUMENTS

| | | |
|---|---|---|
| 4142871 | 12/1991 | Germany . |
| 9305533 | 3/1993 | WIPO . |

OTHER PUBLICATIONS

Kaiser et al., Operation of a Quadrupole Ion Trap Mass Spectrometer to Achieve High Mass/Charge Ratios International Journal of Mass Spectrometry and Ion Processes, 106 (1991) 79–115, Elsevier Science Publishers B.V. Amsterdam.

Vedel et al., New Schemes for Resonant Ejection in R.F. Quadrupolar Ion Traps, International Journal of Mass. Spectrometry and Ion Processes, 99 (1990) 125–138 Elsevier Science Publishers B.V. Amsterdam.

*Primary Examiner*—Jack I. Berman
*Assistant Examiner*—James Beyer
*Attorney, Agent, or Firm*—Bookstein & Kudirka

[57] ABSTRACT

The invention relates to an improved method and an apparatus for the mass-sequential ejection of ions from an RF quadrupole ion trap by electrical alternating fields which are generated in addition to the quadrupolar RF storage field and with different frequencies to it. In contrast to the already known ejection by a pure dipole field, the ions are here essentially ejected by a quadrupole field. The ions leave the ion trap through a perforated end cap and can be detected outside it with conventional means. A weak dipole field undertakes only excitation of the secular oscillation at the center, the amplitude increasing in linear manner in the stationary case. The more intense quadrupole field undertakes further widening of the oscillations with exponential growth in amplitudes. The dipole field is generated by an alternating voltage between the two end caps, while the quadrupole field is generated by an alternating voltage between the end caps on the one hand and the ring electrode on the other. The method is of particular use for the ions of very high masses ranging from approximately 5,000 u to 50,000 u. With the same mass resolution, it permits mass spectra to be recorded considerably quicker than the hitherto conventional use of pure dipole fields.

19 Claims, 7 Drawing Sheets

EJECTION OF IONS FROM ION TRAPS BY COMBINED ELECTRICAL DIPOLE AND QUADRUPOLE FIELDS

FIELD OF THE INVENTION

The invention relates to a method and an apparatus for mass-sequential ejection of ions from an RF quadrupole ion trap by electrical alternating fields which are generated in addition to the quadrupolar RF storage field and with different frequencies to it.

BACKGROUND OF THE INVENTION

It is known (R. E. Kaiser et al., Rapid Commun. Mass Spectrom. 3, 225 (1989), R. E. Kaiser et al., Int. J. Mass Spectrom. Ion Processes 106, 79 (1991)) how to eject the ions mass-sequentially by a fixed dipole alternating field while slowly increasing the amplitude of the storage radio frequency linearly. The dipole alternating field is generated by an alternating voltage applied to the two end caps of the ion trap. The ions leave the ion trap through a perforated end cap and can be detected outside the trap with conventional means. The method is particularly used for ions of very high masses in the range from approximately 5,000 u to 50,000 u.

If ions with different mass-to-charge ratios are stored in an RF quadrupole ion trap according to Wolfgang Paul and Helmut Steinwedel (U.S. Pat. No. 2,939,952), they can, according to present knowledge, be ejected mass-selectively, i.e. temporally separated in the order of their mass-to-charge ratios, by three different methods in an axial direction through one of the two end caps and detected outside in the form of a mass spectrum. For reasons of simplicity, only masses and not mass-to-charge ratios are referred to in the following. Although, strictly speaking, this applies only to singly charged ions, it should not be understood in a restricted sense here. The three mass selective ejection methods are as follows:

(I) The "mass selective instability scan" (U.S. Pat. No. 4,540,884) uses the stability limit $\beta_z=1$ of the first stability region in Mathieu's stability diagram. (See the following relevant literature: P. H. Dawson, "Quadrupole Mass Spectrometry and its Applications", Elsevier, Amsterdam, 1976; and R. E. March and R. J. Hughes, "Quadrupole Storage Mass Spectrometry", John Wiley & Sons, New York 1989). The working points of the ions are shifted across the stability border $\beta_z=1$ by a continuous change in the operating parameters of the ion trap. To do so, the RF voltage of the storage field, the so-called drive voltage of the ion trap, is preferably enlarged linearly, this operating method resulting in a linear mass scale. The ions becoming instable according to their order of mass enlarge their oscillation amplitude in the axial direction ("z" direction) on the other side of the stability border by the absorption of energy from the storage RF field in a temporally exponential manner and are finally able to leave the storage space of the ion trap through perforations in one of the end caps. Given certain conditions for the precise form of the quadrupole field (U.S. Pat. No. 5,028,777), this method provides spectra with a good mass resolution, i.e. ions of one mass are fully ejected and can be completely measured before it is the turn of ions of the next mass.

(II) The "scan by nonlinear resonances" (U.S. Pat. No. 4,818,869 and U.S. Pat. No. 4,975,577) uses the amplitude growth, which our findings show to be sharply hyperbolic, in the secular oscillations due to nonlinear resonance conditions which arise in the ion trap due to superposition of the quadrupole field with higher-order multipole fields. As a result of the hyperbolic amplitude growth in the nonlinear resonance, this method leads to particularly quick scanning with a good mass resolution. Since the multipole fields at the center of the ion trap disappear, ions resting at the center after cooling with a collision gas are unable to experience the nonlinear resonances. They therefore need to be pushed through a dipole alternating field, the frequency of which is the same as or a little lower than the resonance frequency. The mass flow is generated as in method (I) by changing the operating parameters of the ion trap, preferably by a linear change in its drive voltage.

(III) In addition, the ions can be expelled from the ion trap by resonant dipolar excitation in the axial direction. The dipole field is generated by an alternating voltage which is applied between the two end caps. Initial applications of the method are known from as long ago as the 1950s. A detailed description of the various ejection options is given in U.S. Pat. No. Re. 34,000 (reissue of U.S. Pat. No. 4,736,101). The most successful method is to leave the frequency of the alternating voltage applied at the end caps for generation of the dipole field constant and to linearly increase the drive voltage of the ion trap. This causes the ions to undergo a change in the frequency of their secular oscillations. If the secular oscillations of a mass's ions enter into resonance with the dipole alternating field in the z-direction, the ion oscillations absorb energy from the dipole alternating field and enlarge their oscillation amplitude, enabling them to leave the ion trap if the dipole alternating field is sufficiently strong.

Method (I) cannot be used for the ions of very high masses exceeding approximately 5,000 atomic units of mass u since the RF voltage is limited to approximately 15 kV by practical ion trap requirements such as gas pressure in the ion trap and insulation distances. A collision gas pressure of approximately $10^{-3}$ millibars must normally be maintained in ion traps. With the limitation to approximately 15 kV and a minimum frequency of approximately 500 kHz, which depends on the required number of storable ions, conventional ion traps have a resulting upper limit of approximately 4,000 u for the practically usable mass range.

The mass range of method (II) is only marginally higher since the effective nonlinear resonances are not very far away from the instability limit. The most effective resonance at the point $\beta_z=2/3$ of the hexapole field is only approximately 12% higher in mass than the stability limit $\beta_z=1$, related to the same RF voltage. All higher nonlinear resonances (from approximately $\beta_z<1/2$) cannot be used for this method since they are far too weak.

For this reason, method (III) has so far been used for ions of very high masses in the range of some 10,000 unified atomic mass units u (R. E. Kaiser et al., Rapid Commun. Mass Spectrom. 3, 225 (1989), R. E. Kaiser et al., Int. J. Mass Spectrom. Ion Processes 106, 79 (1991)). The method has, however, a serious drawback: it is extremely slow. In the papers above, approximately 500 secular oscillations were required for ejection of the ions of a mass to achieve a single mass resolution just resulting in the separation of two adjacent masses. The scan speed for this single mass resolution (not a high resolution) must therefore not exceed one mass unit for every 500 secular oscillations. In this regard, it must be taken into account that the secular oscillations of the heavy ions are very slow. (In the $\beta_z<0.6$ range, the secular oscillation frequencies $\omega_z$ are approximately inversely proportional to the mass). In comparison, ions of one mass can be completely ejected in approximately 10 secular oscillations with method (II), while commercial equipment working according to method (I) uses a scan speed of approximately one mass per 90 secular oscillations. With a dipole alternating frequency of 25 kilohertz, method (III) provides a scan speed of only 50 mass units per second, while method (II) measures 30,000 mass units per second, though at 333 kilohertz in the lower mass range.

Physical Principles

Our most recent examinations have shown that the increase in amplitude of the secular oscillation in a resonant alternating field depends on the multipole ordinal number of the exciting alternating field. It can be shown that the following differential equation holds for the temporal increase in amplitude in the z-direction:

$$dz/dt=C_n*z^{(n-1)},\ \text{n=multipole order.} \quad (1)$$

Integration produces the following:

$$z_1(t)=C'_1*t \text{ a linear increase for the dipole (n=1),} \quad (2)$$

$$z_2(t)=C'_2*exp(t) \text{ an exponential increase for the quadrupole (n=2)} \quad (3)$$

$$z_3(t)=C'_3/(t-C''_3) \text{ a hyperbolic increase for the hexapole (n=3).} \quad (4)$$

Equations (2), (3), and (4) have been verified by computer simulations. Equation (2) was simulated by an electrical voltage at the end caps, equation (3) tested by means of the increase in amplitude at a fixed working point in the instable range, and equation (4) at different nonlinear resonances of superposition with a hexapole field which was generated by the shape of the electrodes. FIGS. 1 to 3 show the results of the computer simulations.

It can be expected from these examinations that equation (3) with an exponential rise in the secular oscillation amplitude also applies to the case of superposition with a resonant quadrupole alternating field generated by electrical means with an alternating voltage between the ring and end cap electrodes.

Therefore, it is among the objects of the invention to specify a fast scan method for the spectra of ions in a quadrupole ion trap, which, in particular, can be used for ions of very high masses.

SUMMARY OF THE INVENTION

The invention comprises replacing pure dipole excitation of the ion oscillations of method (III) by combined dipole and quadrupole excitation, both being generated by electrical alternating voltages at the electrodes of the ion trap.

Here, dipole excitation can be very much weaker than in method (III). Its sole purpose is to make the ions, which normally rest at the center of the ion trap due to cooling with a collision gas, slightly oscillating. Since the quadrupole field disappears precisely at the center, the ions at the center would not see resonant acceleration by the quadrupole field at all. The small cloud of ions of the same mass resting at the center begins to oscillate synchronously and in relatively closed form due to the dipole alternating field.

As soon as the ions then reach positions well away from the center, they are caught by the quadrupolar acceleration which, as expected, enlarges their oscillation amplitude not only linearly, but exponentially. As a result, the oscillations are quickly extended to the end caps, causing the cloud's ions to be ejected through the perforations in the end caps, podion by portion in a few subsequent oscillations of the secular motion.

BRIEF DESCRIPTION OF THE DRAWINGS

The above and further advantages of the invention may be better understood by referring to the following description in conjunction with the accompanying drawings, in which.

DETAILED DESCRIPTION OF ILLUSTRATIVE EMBODIMENTS

Figure 1:
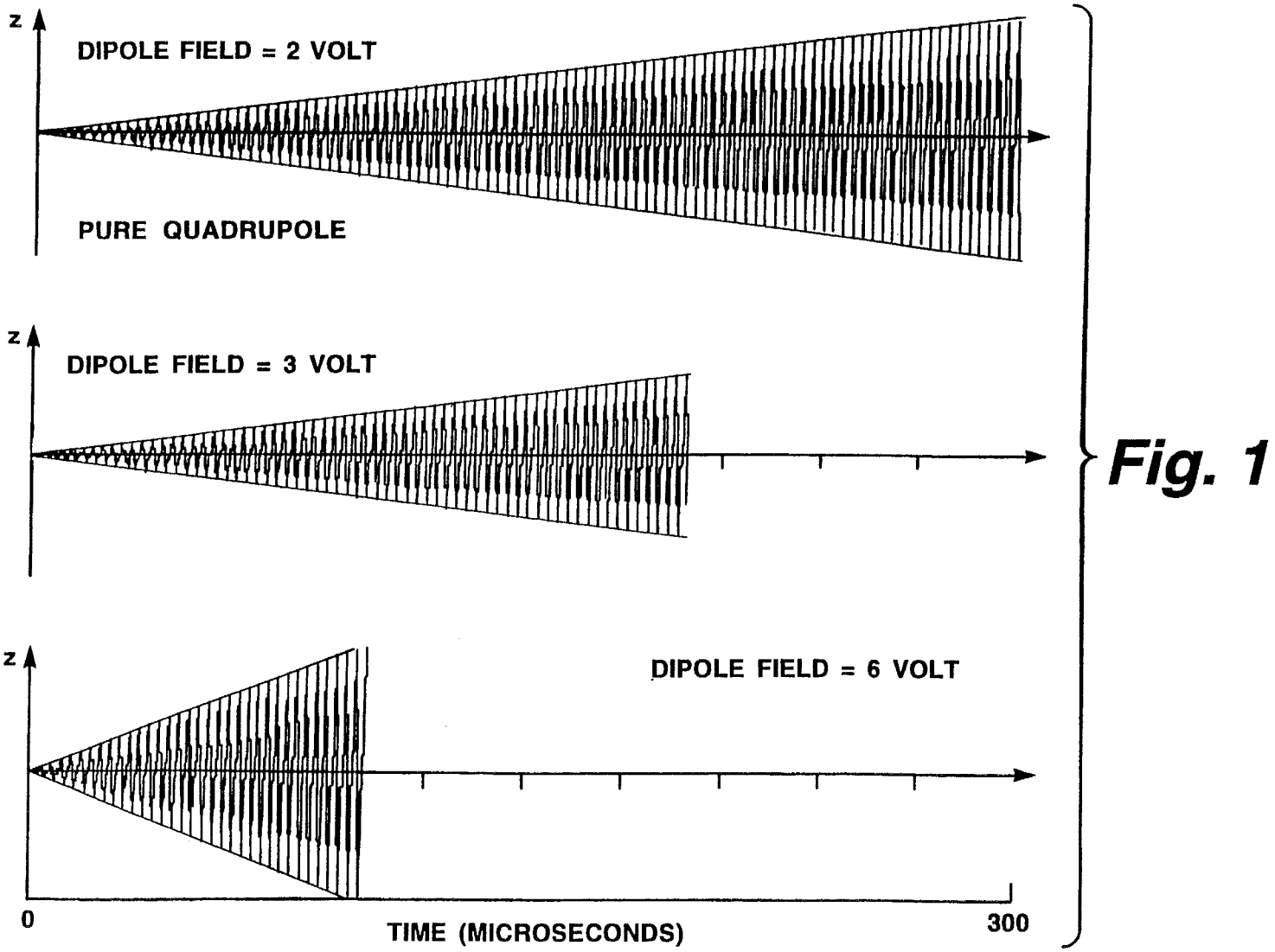
FIG. 1 describes the linear increase in amplitude of a secular ion oscillation in a resonant dipole alternating field generated electrically via the end caps. The z-amplitude of the oscillation was differentially calculated by a simulation program.
Figure 2:
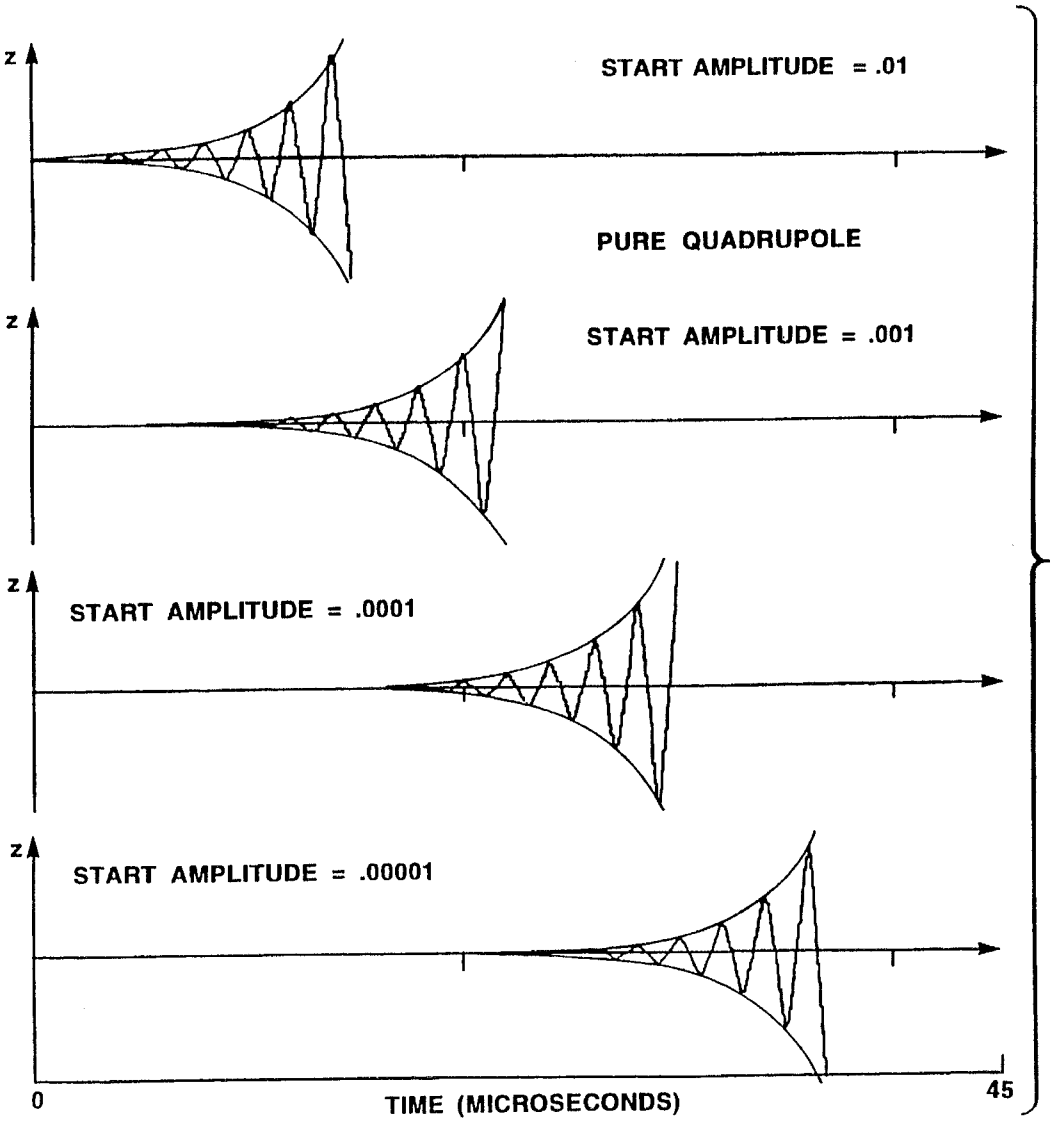
FIG. 2 demonstrates the exponential increase in amplitude in a quadrupole field. The working point of the oscillating ion is located a little outside the stability region. The simulation describes a stationary situation, no change taking place in the operating parameters of the ion trap.
Figure 3:
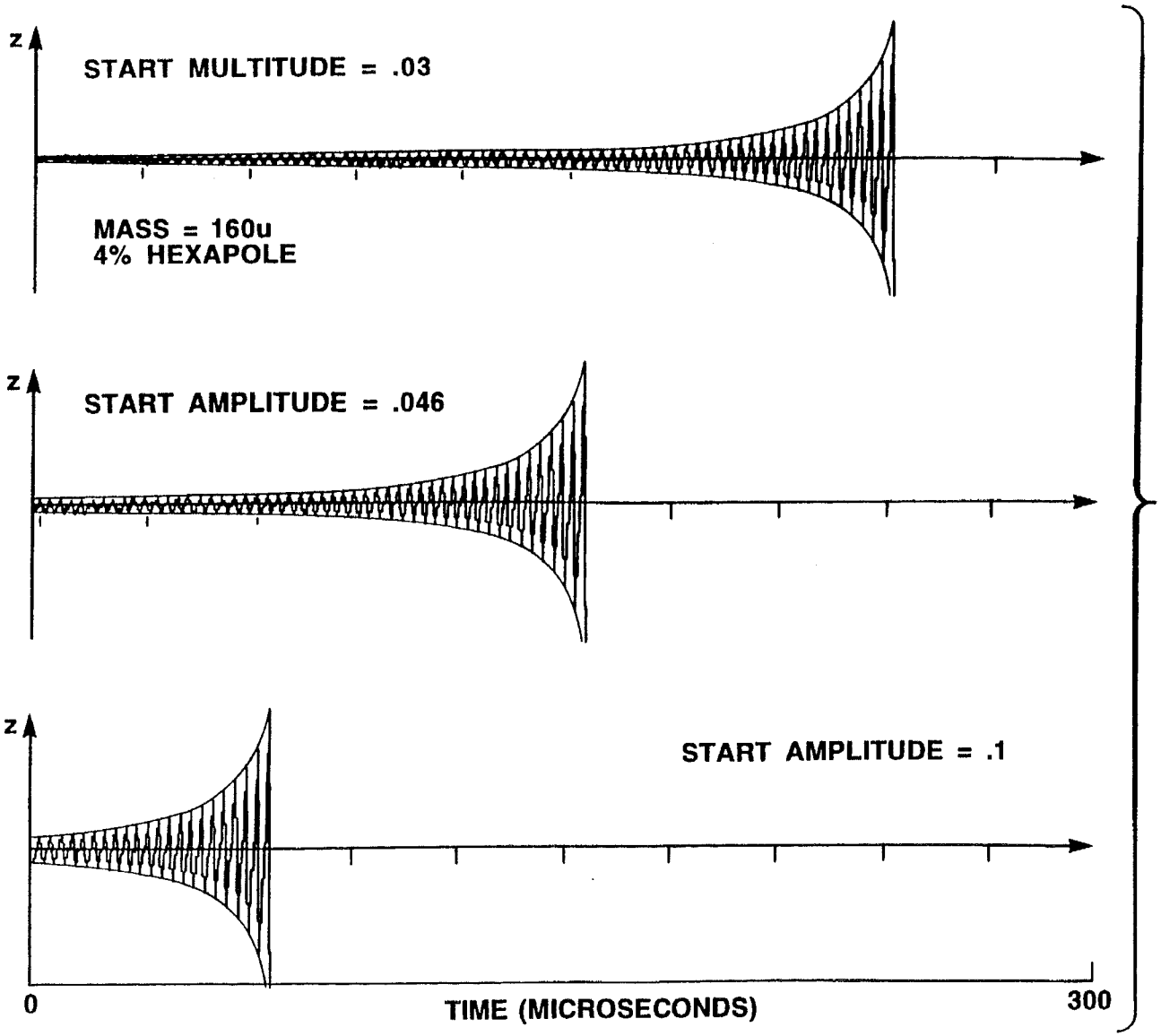
FIG. 3 shows the hyperbolic increase in oscillation amplitude in the nonlinear z-direction resonance $\beta_z=2/3$ of a superposed, weak hexapole field. The hyperbolic increase leads to a particularly sharp rise in amplitude and is responsible for the high measuring speed for spectra which can be achieved with this method.
Figure 4:
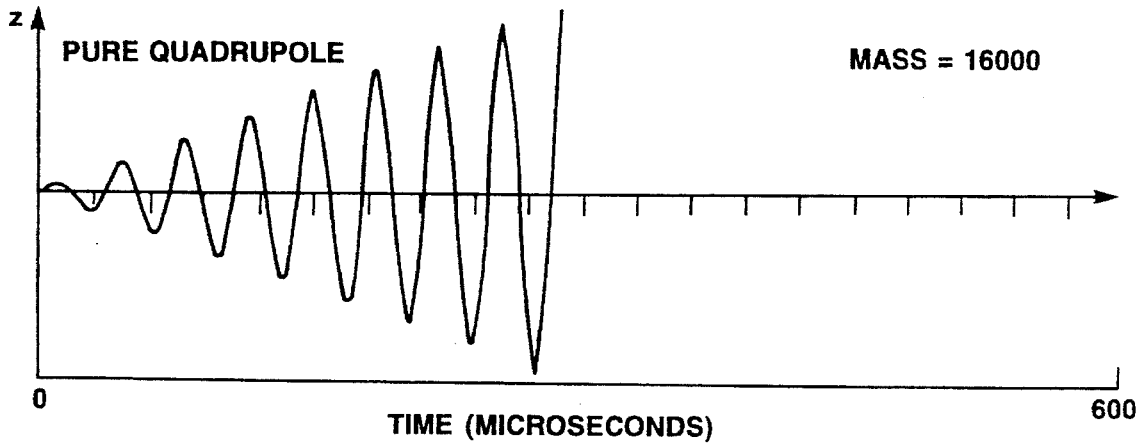
FIG. 4 shows the linear increase in amplitude for a very heavy ion of 16,000 u mass in stationary mode. A dipole alternating voltage of 20 volts and 28.5 kilohertz is required for this.

FIG. 4 shows the linear increase in amplitude of the secular oscillation of a very heavy ion of 16,000 u mass under the effect of an applied dipole field, the frequency of which is in resonance with the secular oscillation. The dipole field is approximately generated by a 20 volt and 28.5 kHz alternating voltage which is applied diagonally across the two end caps. Before the commencement of excitation by the dipole field, the ion was resting precisely at the center of the ion trap. Here, the stationary case of constant operating conditions for the ion trap is given, no scanning of masses therefore taking place.

Figure 5:
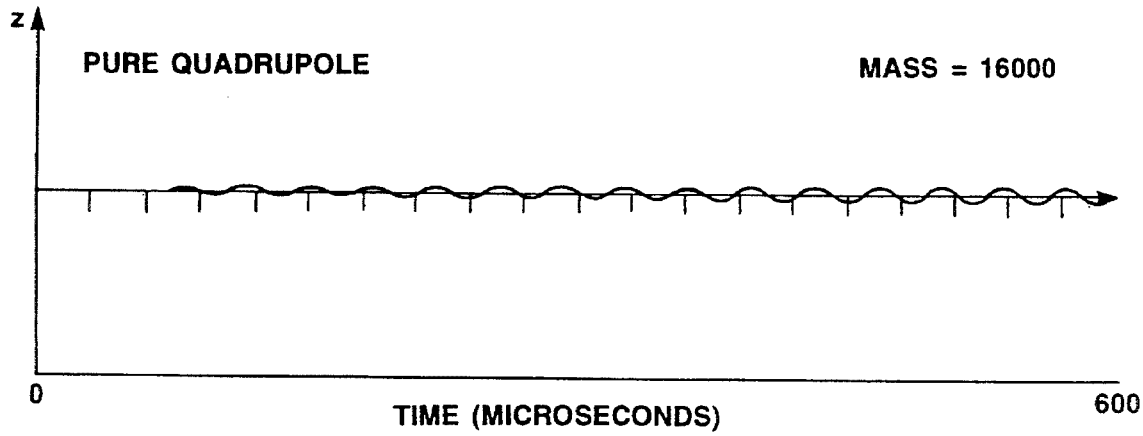
FIG. 5 shows the same linear increase, which, however, with a dipole alternating voltage of only 0.5 volts, is exceptionally slow.

FIG. 5 shows the very weak linear increase in amplitude with a dipole voltage of only 1 volt.

Figure 6:
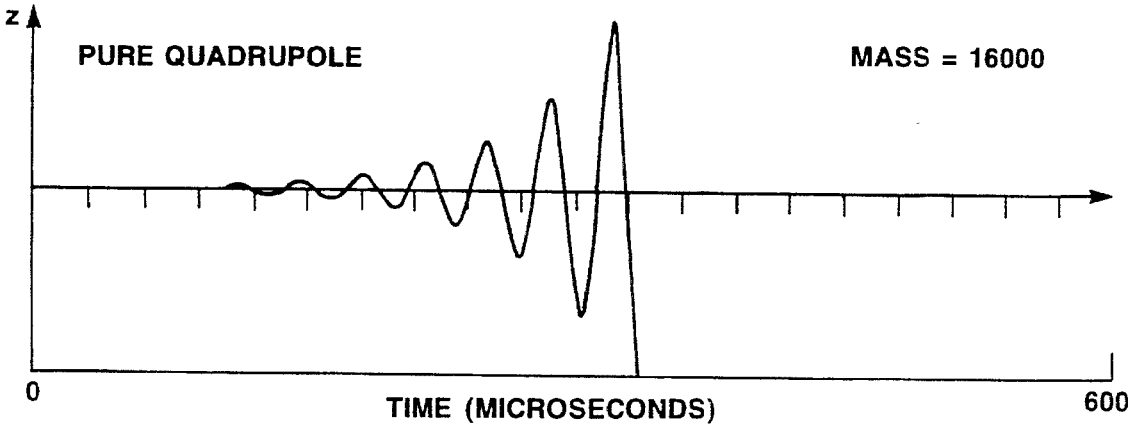
FIG. 6 now shows the effect of a connected quadrupole alternating field of 500 volts and double frequency. The exponential rise in amplitude quickly brings the ion to the end caps which are indicated here as a broken line. In this instance, the dipole alternating field has the same low intensity as in FIG. 5. The dipole field is, however, essential to move the ion away from the center at all. Without the dipole field the ion would remain motionless at the center since the quadrupole field disappears precisely at the center.

In FIG. 6, an additional quadrupole field is switched on, generating an exponential enlargement of the oscillation amplitude. Ejection is significantly sharper as a result. The quadrupolar alternating field is generated by an alternating voltage between the end caps on the one hand and the ring electrode on the other. Although the dipole voltage is only 1 volt as in FIG. 5, the quadrupole voltage, on the other hand, is 500 volts. The quadrupole frequency is twice the value of the dipole frequency. Despite the low dipole voltage of only 1 volt, it would not be possible for the ion to be picked up by the quadrupole acceleration without this voltage since the quadrupole field disappears precisely at the center. Ion ejection therefore corresponds to ejection as per method (II) by nonlinear resonances which also disappear at the center and need a push by a weak dipole voltage. As expected, the amplitude increases exponentially with correct setting of the frequencies and phases. With incorrect setting of the phases, there is a transition region for adaptation of the oscillation phases.

The double frequency of the quadrupole field is particularly advantageous since the ion then undergoes an acceleration in every half phase. The single frequency can also be used, though an even higher voltage is then required. Even-numbered multiples of the frequency, such as a fourfold or sixfold frequency, can also be used, though the acceleration decreases as the frequency rises.

FIGS. 4 to 6 consider only the stationary case of a constant RF drive voltage of the ion trap and not the scan procedure for the mass-sequential ejection of ions as is required for the recording of mass spectra. The results of scanning with very heavy ions are shown in FIGS. 7 and 8.

Figure 7:
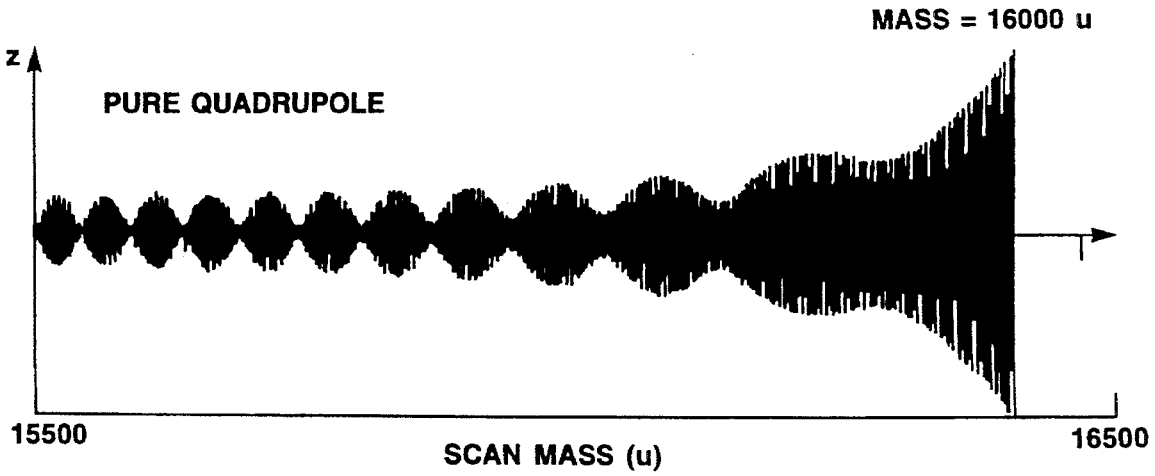
FIG. 7 shows a mass scan with dipole ejection over 1,000 units of mass. The mass of the ion is again approximately 16,000 units, though the mass scale is not precisely calibrated. The mass scan is generated by a linear enlargement of the drive voltage. The ion starts to oscillate to a greater extent well before reaching the resonance point. Beats develop, the beat antinodes and beat amplitudes of which become larger and larger with increasing convergence with the resonance point. A beat antinode develops at the resonance point, the maximum of which is outside the end cap distances, causing ion ejection. Although convergence with the end caps is optimally selected here, it is nevertheless not very sharp. The dipole alternating voltage is 10 volts at 28.5 kilohertz.

FIG. 7 first shows the behavior of a heavy ion in a dipole alternating field of medium intensity in a slow scan over 1,000 units of mass, without switching on the quadrupole field. The dipole voltage is 10 volts and the dipole frequency approximately 28.5 kilohertz. Strong beats form well before the resonance point. The beat antinodes become wider and the beat periods longer, the closer the secular frequency of the ion gets to the resonance point. Here, the 10-volt dipole voltage is just sufficient to eject the ions, representing the optimum case. A voltage of 8 volts is just insufficient for ion ejection while a voltage higher than 10 volts leads to much greater loops of oscillation. Indeed, a dipole voltage of a little more than 8 volts is used by Kaiser et al. (see above) in practical experiments.

If the dipole field were only slightly weaker than shown in FIG. 7, no ejection of ions would take place. After running over the resonance point with a beat antinode of maximum size, the increase in energy of the oscillation would cease. Since the energy is not, however, subsequently released again, the beat retains approximately the same maximum amplitude, even if the beat frequency changes and again becomes quicker.

Figure 8:
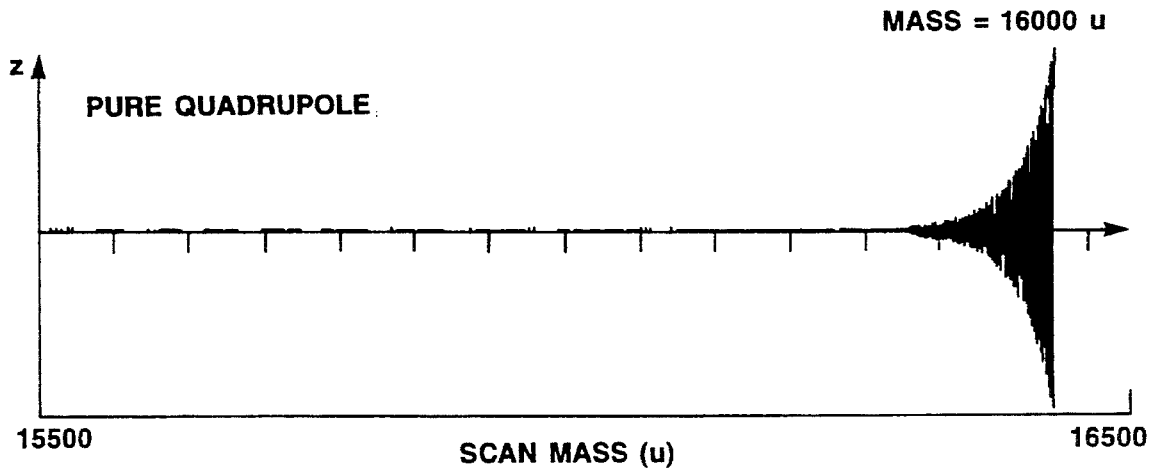
FIG. 8 shows ejection by the dipole and quadrupole field combination. The beats are extremely small and exponential ejection very sharp. Here, the dipole alternating voltage is only 0.5 volts at 28.5 kilohertz while the quadrupole voltage is 50 volts at 57 kilohertz.

FIG. 8 shows the behavior of the ion with a much weaker dipole field with a dipole voltage of only 0.5 volts but an additionally connected quadrupole field of 50 volts and double frequency of approximately 57 kilohertz. Due to the low dipole voltage, the beat antinodes are considerably smaller. The weakly oscillating ion is picked up by the quadrupole alternating field at the resonance point and its oscillation amplitude enlarged exponentially until the ion reaches the end cap. The point of ion ejection is strictly defined with regard to the mass scale and ion ejection is much sharper, i.e. a few secular oscillations suffice for portion-wise ejection of a small cloud. Consequently, a better mass resolution is achieved than the dipole ejection as per FIG. 7 is able to reveal.

The quality of quadrupole resonance at 57 kilohertz is better than that of dipole resonance at 28.5 kilohertz. Consequently, ion ejection is more strictly and more reproducibly bound to a point on the mass scale for this reason.

Before recording the spectra, the ions must be cooled by a collision gas, condensing them in a very small cloud at the center of the ion trap. The collision gas remains in the ion trap, even during recording of the spectra, to counter any continuous reheating of the cloud by the alternating fields and the oscillating ions of other masses during the mass flow.

These heating processes, which are considerable in the case of dipole ejection, are suppressed to a very great extent by the only very weak dipole field since the beat antinodes of the ions are only very small before reaching the resonance point.

Furthermore, fewer deflective scattered collisions between the ions and the collision gas take place since the ions remain at rest much longer with the new ejection method. Consequently, far fewer vagabond scattered ions arise in the ion trap and the noise background generated by them in the spectrum remains low.

The presently known methods (I) and (II) have shown that it is advantageous to excite the ions by a dipole voltage between the end caps before they reach instability in method (I) or nonlinear resonance in method (II). This is done by selecting a slightly lower dipole voltage frequency than that corresponding to the instability or nonlinear resonance frequency. This enables the dipole voltage to again be lowered, making ion ejection even sharper. For this reason, it is here analogously proposed that the dipole frequency be lowered a little below half the quadrupole frequency.

Furthermore, it is known that the quadrupole field can also be generated by applying the full quadrupole voltage (peak-to-peak) only jointly to the two end caps and not to the ring electrode. Any added potential (even alternating potential) is not decisive for the field in the ion trap. The reference point for the voltage is then a joint ground point for the quadrupole voltage and drive voltage.

The dipole field can also be generated if the dipole voltage is applied only to one end cap electrode. This results in a superposition comprising a dipole field and a quadrupole field, each with the same intensity. The quadrupole field can then be left out of consideration for the further examinations due to its low intensity.

Figure 9:
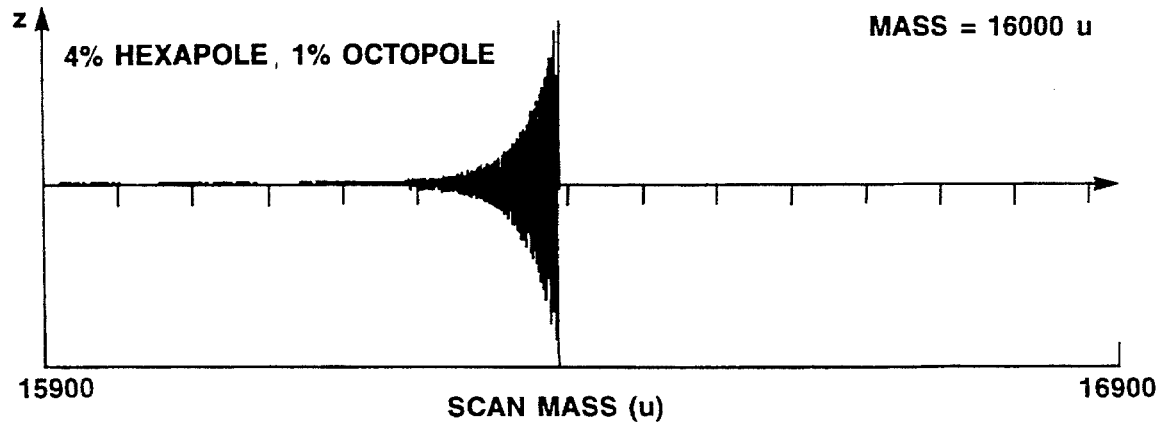
FIG. 9 shows single-sided ion ejection by superposition of a 1% octopole field and 4% hexapole field generated by the shape of the electrodes.
Figure 10:
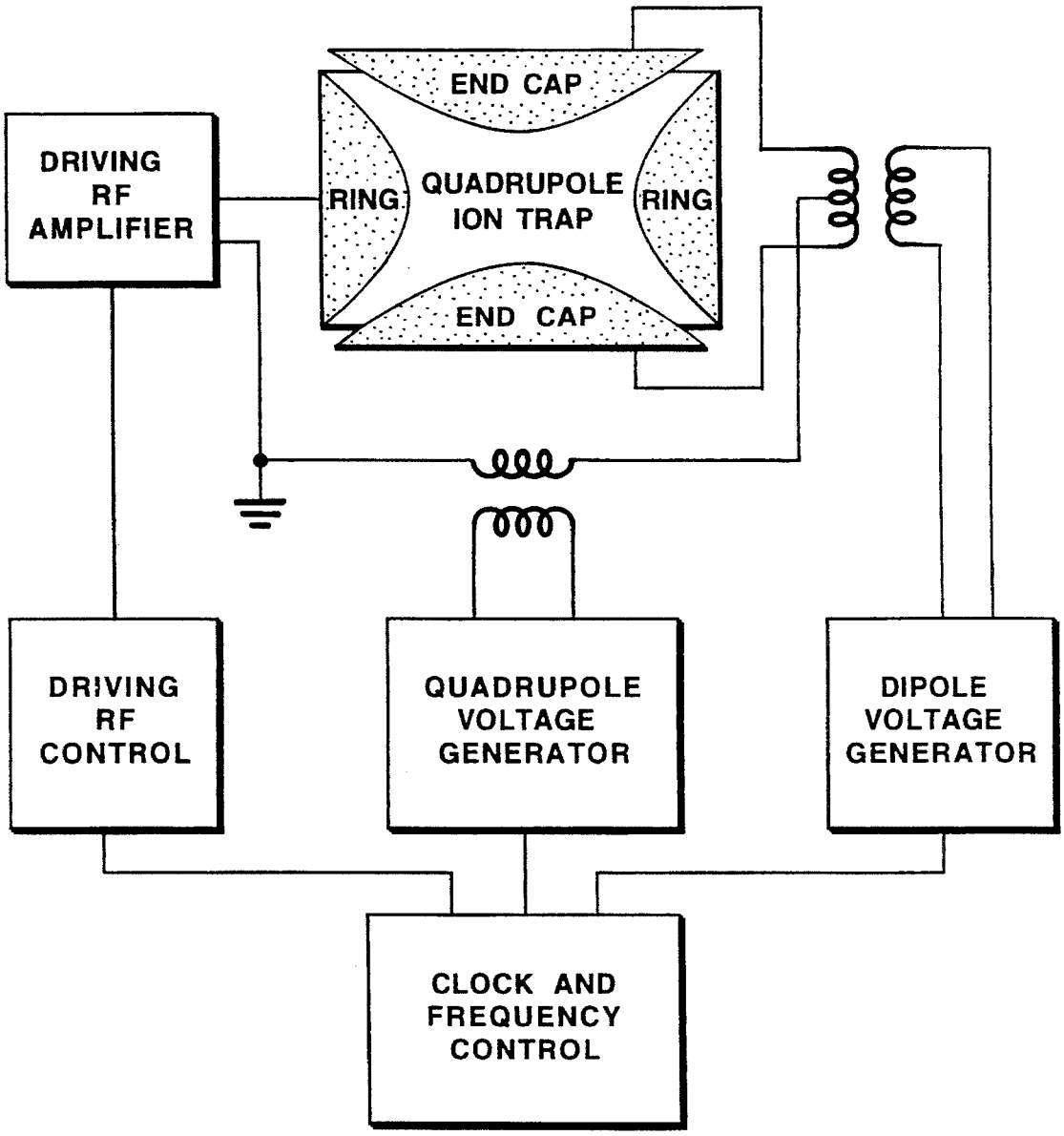
FIG. 10 is a circuit schematic for simultaneously generating dipole and quadrupole alternating fields.
Figure 11:
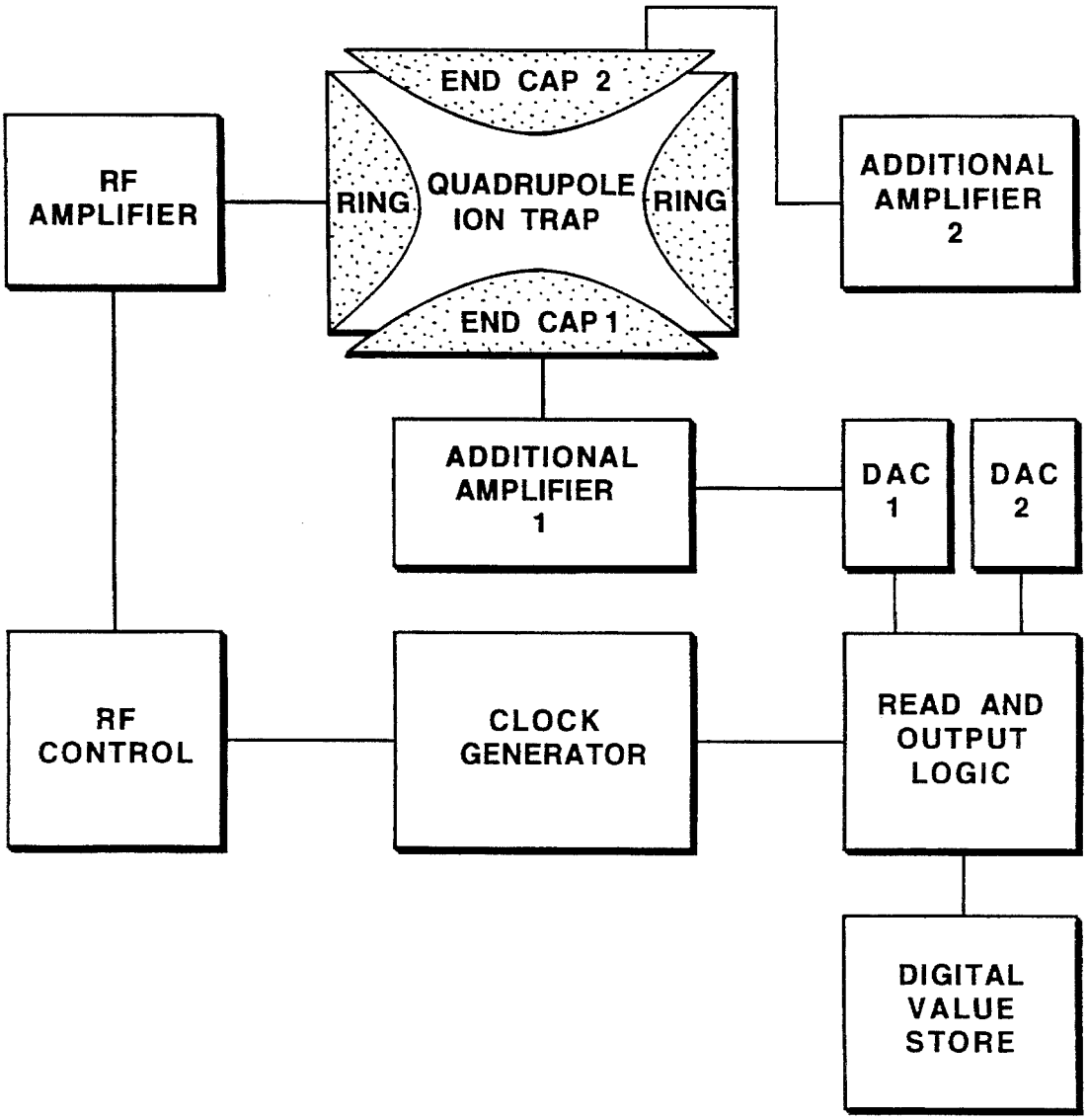
FIG. 11 outlines a principle for digital generation of the alternating voltages at the two end cap electrodes of the ion trap. The amplitudes are calculated and stored before carrying out the measurements. They are supplied to two digital-to-analog converters at a basic pulse rate at the measuring time. The analog voltages are carried to the electrodes post-amplified. In general, post-amplification can also be digitally controlled (not shown here). The intensity of the drive RF voltage is also digitally controlled (not shown), this generating the mass scan.

Superposition of the storage quadrupole field of the ion trap with a weak octopole field, which can be generated by a special shape of the electrodes, has a further sharpening effect on ion ejection. An additional hexapole field, also generated by the shape of the electrodes, causes the ions to always be ejected only through the same end cap, doubling the ion current to be detected outside. It is therefore proposed in an embodiment to superpose higher multipole fields by the shape of the electrodes. Single-sided ion ejection by combined octopole and hexapole fields is shown in FIG. 9.

Furthermore, it is possible to generate the additionally required alternating voltages in a digital manner. Previously calculated and stored values are output to the end caps at a constant generation rate via digital-to-analog converters. In particular, this also enables the voltages required for the two end caps to be generated separately. In addition, this also makes it possible to also generate frequency bands with a mixture of weighted frequencies.

The foregoing description has been limited to specific embodiments of this invention. It will be apparent, however, that variations and modifications may be made to the invention, with the attainment of some or all of its advantages. Therefore, it is an object of the appended claims to cover all such variations and modifications as come within the true spirit and scope of the invention.

What is claimed is:

1. A method for mass-to-charge selective ejection of ions with improved mass resolution from an RF quadrupole ion trap comprising:

a) defining an ion trap with a ring electrode and two end cap electrodes, with perforations in at least one of the end cap electrodes;

b) creating an RF quadrupole storage field by applying an RF drive voltage to the ring electrode;

c) filling the ion trap with ions of interest:

d) ejecting a quantity of said ions which have a selected mass-to-charge ratio through the perforations in one of the end cap electrodes by resonantly exciting axial secular oscillations of said quantity of ions using a combination of a weak dipolar AC excitation field and a strong quadrupolar AC excitation field: and e) measuring the ejected ion current.

2. The method of claim 1 wherein step d) further comprises the steps of:

d1) generating the dipolar AC excitation field by application of a first AC voltage across the two end caps: and d2) generating the quadrupolar AC excitation field by application of a second AC voltage between the ring electrode and the end cap electrodes.

3. The method of claim 2 wherein the amplitude of the second AC voltage is at least five times greater than the amplitude of the first AC voltage.

4. The method of claim 1 further comprising the step of superposing the RF quadrupole field with higher multipole fields having the same frequency as the RF quadrupole storage field by specially shaping surfaces of and distances between the ring electrode and the end cap electrodes.

5. The method of claim 2 wherein the frequency of the second AC voltage is exactly two times the frequency of the first AC voltage.

6. The method of claim 2, wherein the frequency of the second AC voltage is an exact even multiple of the frequency of the first AC voltage.

7. The method of claim 2 wherein the second AC voltage has the same frequency as the first AC voltage.

8. The method of claim 5 wherein the frequency of the RF drive voltage is an exact multiple of the frequency of the first AC voltage.

9. The method of claim 8 wherein a phase of the first AC voltage and a phase of the second AC voltage can be adjusted with respect to a phase of the drive voltage.

10. The method of claim 5 wherein the phase of the first AC voltage can be adjusted with respect to the phase of the second AC voltage.

11. The method of claim 1 wherein the dipolar AC excitation field is generated by a first AC voltage applied to one end cap, with the other end cap grounded, and the quadrupolar AC excitation field is generated by a second AC voltage applied to the ring electrode.

12. The method of claim 9 further comprising the step of generating the dipole and quadrupole excitation fields by separate digital generation of the AC voltages at the end caps.

13. The method of claim 1 further comprising the step of generating a mass-sequential ejection of ions by a continuous change in at least one of the following electrical variables: an amplitude of said RF drive voltage: a frequency of the RF drive voltage: a DC voltage applied to the ring electrode: and frequencies of a first AC voltage and a second AC voltage used to generate the dipolar AC excitation field and the quadrupolar AC excitation field, respectively.

14. The method of claim 13 wherein only the RF drive voltage is changed for mass-sequential ion ejection.

15. The method of claim 14 further comprising changing the RF drive voltage linearly in time to generate a mass-to-charge scale which is linear with time.

16. The method of claim 15 further comprising generating said first AC voltage at a frequency which is below one half of the frequency of said second AC voltage by an amount between 0.5 kHz and 3 kHz, such as to weakly expose the ions first to a resonance with the dipolar excitation field and shortly thereafter to a stronger resonance with the quadrupolar excitation field which ejects the ions.

17. The method of claim 1 further comprising generating said AC excitation fields with two digitally produced voltage mixtures applied separately to the two end cap electrodes such as to produce two different AC voltages at the end caps, one having a phase opposite to the phase of the RF drive voltage to generate the dipolar field, and one having a phase equal to the phase of RF drive voltage to generate the quadrupole field.

18. An RF quadrupole ion trap mass spectrometer comprising:

a) a ring electrode and two end cap electrodes;

b) an RF drive voltage supply, connected to the ring electrode;

c) a transformer having secondary windings which are connected to both end cap electrodes;

d) a first voltage supply of frequency f for a dipolar AC excitation field, an output of tile voltage supply being connected to primary windings of the transformer; and a second voltage supply of frequency 2f for a quadrupolar AC excitation field, connected to the ring electrode and to a middle winding of the secondary windings of the transformer.

19. An RF quadrupole ion trap mass spectrometer comprising:

a) a ring electrode and two end cap electrodes;

b) an RF drive voltage supply, connected to the ring electrode; and c) two frequency mixture generators operated by digital input values each connected to one of the end caps, where the frequency mixture generates a dipolar field of frequency f, and a quadrupolar field of frequency 2f.

* * * * *